US005239786A

United States Patent [19]

Carpenter

[11] Patent Number: 5,239,786

[45] Date of Patent: Aug. 31, 1993

[54] INSIDE PIPE CLEANER

[75] Inventor: James H. Carpenter, Hagerstown, Md.

[73] Assignee: Pangborn Corporation, Hagerstown, Md.

[21] Appl. No.: 871,993

[22] Filed: Apr. 22, 1992

[51] Int. Cl.[5] ..... B24C 3/32; B24C 3/06; B24B 1/00

[52] U.S. Cl. ..... 51/411; 51/319; 51/290; 51/429; 51/424; 51/435

[58] Field of Search ..... 51/411, 429, 410, 424, 51/435, 281 R, 319, 317, 290

[56] References Cited

U.S. PATENT DOCUMENTS

| | | | |
|---|---|---|---|
| 3,151,418 | 10/1964 | Powell | 51/411 |
| 3,348,339 | 10/1967 | Bowling | 51/435 |
| 3,824,738 | 7/1974 | Hall | 51/411 |
| 3,835,587 | 9/1974 | Hall, Jr. | 51/411 |
| 4,016,814 | 4/1977 | Leliaert | 51/411 |
| 4,036,173 | 7/1977 | Nicklas | 51/411 |
| 4,174,593 | 11/1979 | Maeda | 51/435 |
| 4,277,965 | 7/1981 | Rutten | 51/435 |
| 4,723,377 | 2/1988 | Watts | 51/411 |
| 4,941,297 | 7/1990 | Carpenter | 51/435 |

FOREIGN PATENT DOCUMENTS

| | | | |
|---|---|---|---|
| 34491 | 11/1925 | Denmark | 51/411 |
| 2533952 | 2/1977 | Fed. Rep. of Germany | 51/411 |
| 3309941 | 9/1984 | Fed. Rep. of Germany | 51/435 |
| 1301673 | 4/1987 | U.S.S.R. | 51/411 |

*Primary Examiner*—Bruce M. Kisliuk
*Assistant Examiner*—Bo Bounkong
*Attorney, Agent, or Firm*—Charles E. Brown

[57] ABSTRACT

This relates to a pipe cleaner for cleaning pipe interiors such as gas and oil pipelines. The pipe cleaner is adjustable for cleaning pipes of different diameters beginning as low as 12" inside diameter. However, the usual requirement for gas and oil line pipes is between 20" to 48" diameters with it being feasible to clean pipes of greater diameters. The pipe cleaner includes a cleaning head carried by a boom with the pipe cleaner consisting primarily of a high performance blast wheel driven by a hydraulic motor. The blast wheel is provided with radiating vanes which are of a flared construction and with alternating vanes being differently shaped so as to provide for a wide pattern of abrasive particles. The cleaning head is positioned within the pipe to be cleaned by being carried by a boom with the pipe being supported coaxial with that of the boom and being rotated. The boom is supplied with compressed air into which abrasive particles for the blast wheel are fed with the abrasive being carried by the compressed air and being separated from the compressed air in the cleaning head. Used abrasive particles are returned to a hopper from which the abrasive particles are dumped into a travelling hopper connected to the boom at the time the cleaning head is placed entirely within the pipe. After cleaning, the pipe is tilted so as to cause flow of abrasive particles and foreign material down therethrough into a receptacle.

20 Claims, 5 Drawing Sheets

INSIDE PIPE CLEANER

This invention relates in general to new and useful improvements in pipe cleaners, and more particularly to a cleaner which is operable to clean the insides of pipes of a wide range of diameters.

A number of attempts have been made over the years to devise an inside pipe cleaner that will clean fast, fit into a small pipe diameter and be relatively simple mechanically.

Pipe cleaners using nozzles as shown in U.S. Pat. Nos. 4,314,427, 4,380,477 and 4,557,079 will fit in small diameter pipes. However, the cleaning rate with these pipe cleaners is slow when compared to the cleaning rate of a blast wheel of the type utilizing a rotating head carrying throwing vanes.

Pipe cleaners utilizing centrifugal wheels to date are usually complex mechanically and will not fit into small diameter pipes. Such pipe cleaners are disclosed in U.S. Pat. Nos. 3,750,339; 3,824,738; 3,835,587 and 3,857,202.

In accordance with this invention, there has been developed a compact, relatively simple mechanically and a fast and efficiently operating pipe cleaner which will meet all of the usual requirements for cleaning gas and oil pipelines ranging from 20" to 48" pipe diameter and greater.

Most simply, the pipe cleaner includes a support on which a pipe to be cleaned is rested with the support being adjusted to compensate for differences in pipe diameter while maintaining the center of the pipe along the same axis as the movement of the pipe cleaner to provide for an efficient interior cleaning of pipes of varying diameters.

With the above and other objects in view that will hereinafter appear, the nature of the invention will be more clearly understood by reference to the following detailed description, the appended claims, and the several views illustrated in the accompanying drawings.

IN THE DRAWINGS

FIGS. 1A and 1B form a side elevational view of a pipe cleaner constructed in accordance with this invention, the pipe being shown in dotted lines in FIG. 1A in an abrasive removal position.

Figure 1A:
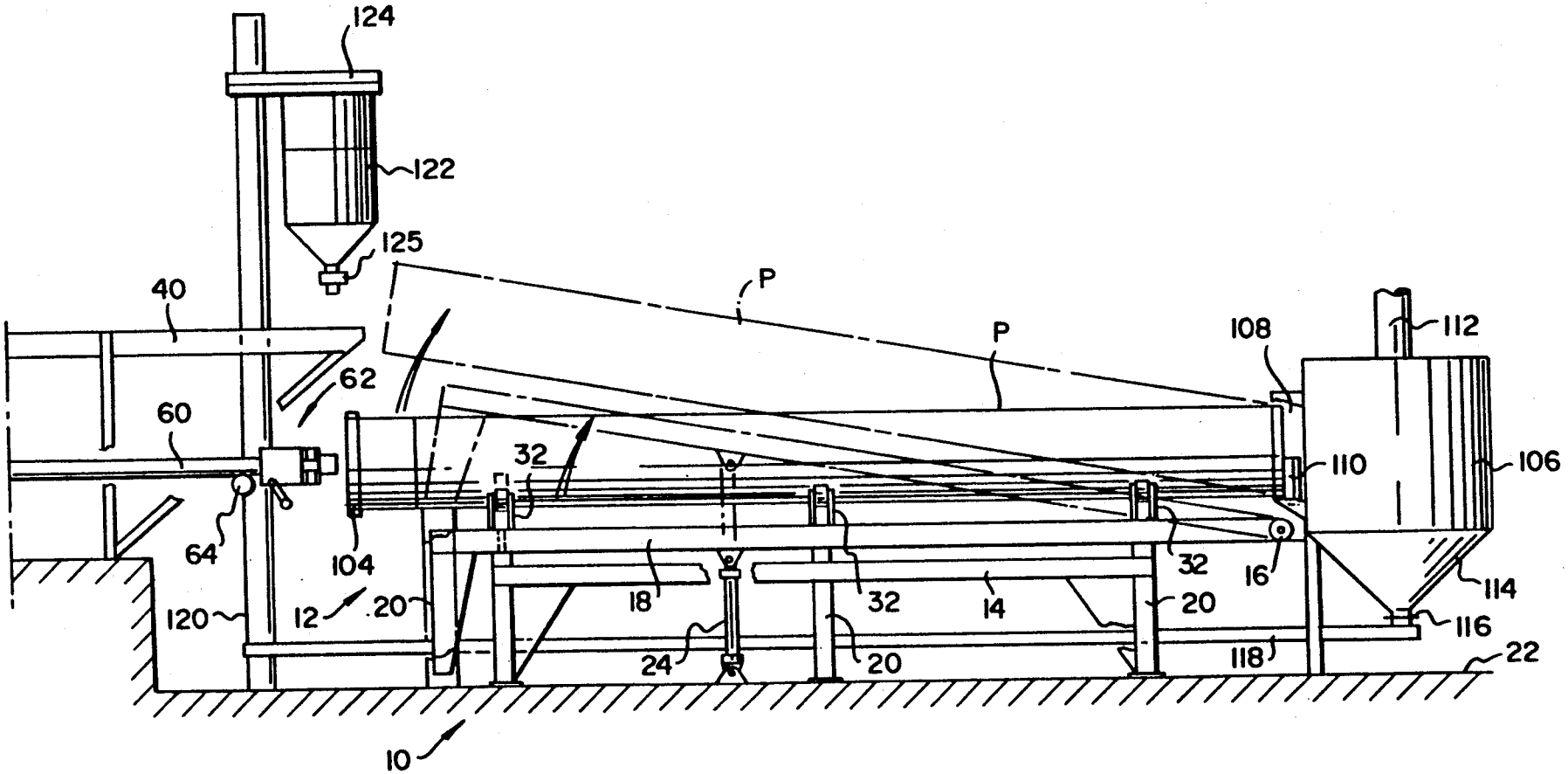
Figure 3:
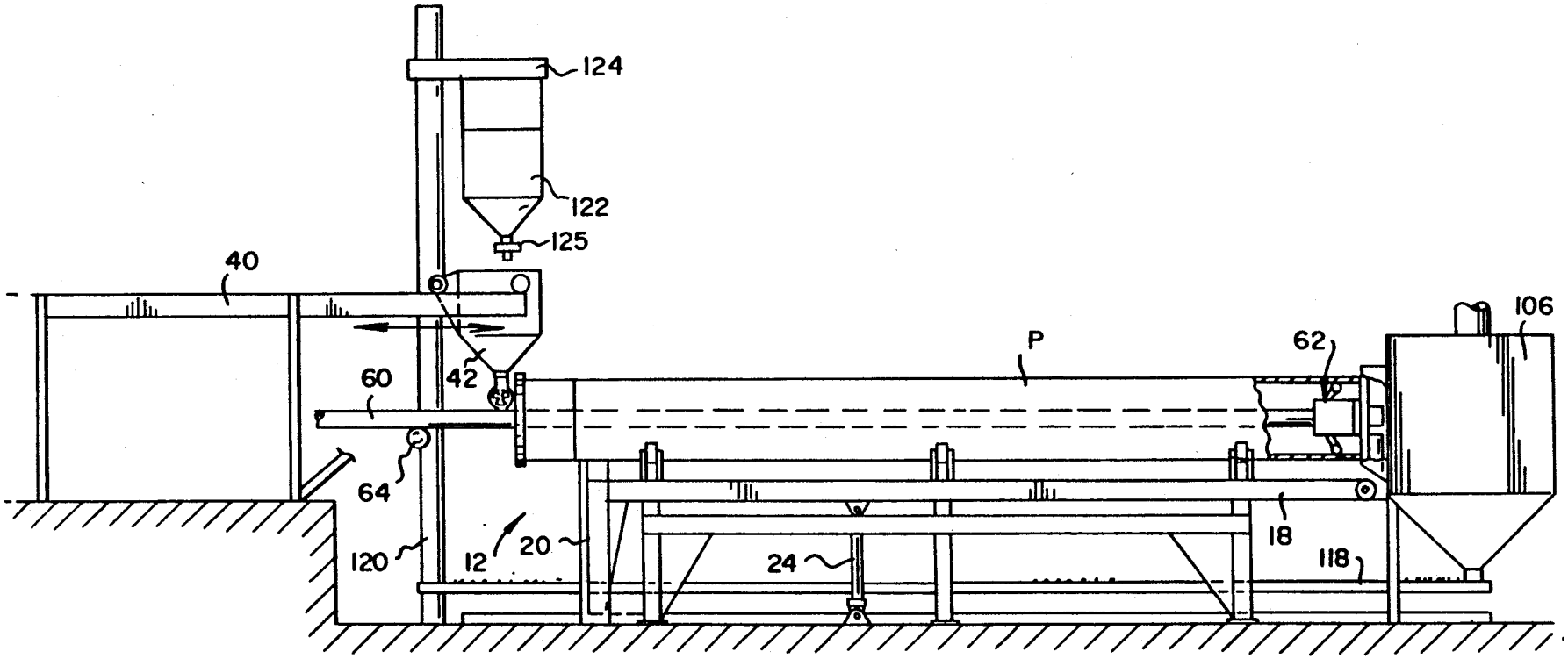
FIG. 3 is a side elevational view similar to FIG. 1A with parts broken away and shown in section and the cleaning head in its fully extended position at the far end of the pipe to be cleaned and the abrasive hopper associated with the cleaning head being refilled.

Referring now to the drawings in detail, it will be seen that there is illustrated the details of an inside pipe cleaner which is the subject of this invention, the pipe cleaner being generally identified by the numeral 10. The pipe cleaner 10, as is best shown in FIGS. 1A and 3 includes a pipe support generally identified by the numeral 12. The pipe support 12 includes a supporting frame 14 which has pivotally mounted thereon as at 16 one end of a support frame 18. The support frame 18 is provided with a plurality of supporting legs 20 which are normally seated on a suitable base 22. The support frame 18 is further supported by an extensible jack 24 which, when extended, elevates the left end of the support frame 18 with the support frame 18 pivoting about the pivot 16 so as to tilt a pipe P seated on the support frame 18 as is shown in dotted lines in FIG. 1A.

Figure 6:
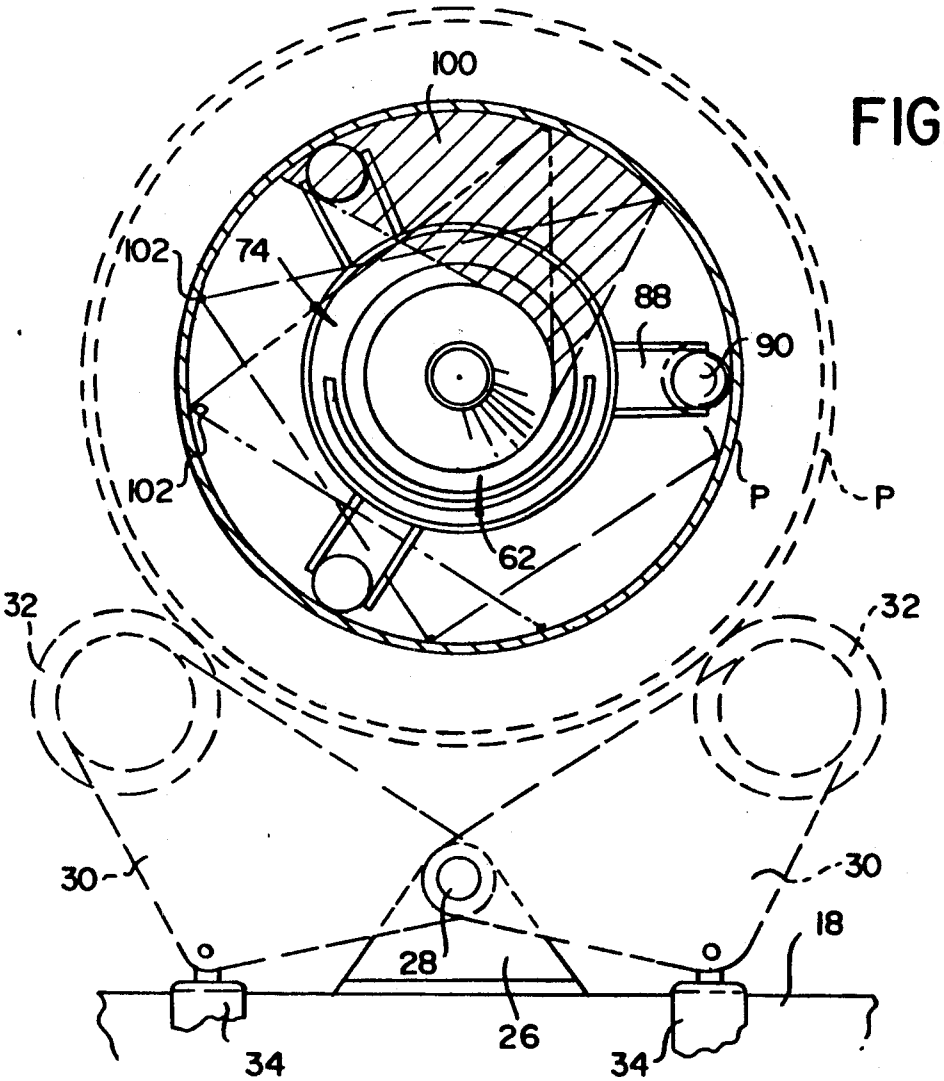
FIG. 6 is a transverse sectional view taken generally through FIG. 5 and shows both the manner in which different diameter pipes may be supported for cleaning and the manner in which the cleaning head is adjustable to stabilize the same within pipes of different diameters.

As is best shown in FIG. 6, the support frame 18 is provided with a plurality of center supports 26 which have pivotally connected thereto as at 28 pairs of pivotally mounted arms 30. Each of the arms 30 carries for rotation a roller 32.

As will be apparent from FIG. 6, by adjusting the heights of the rollers 32, pipes P of different diameters may be supported on the same axis. In order to vary the height of the rollers 32, there is associated with each of the arms 30 a support jack 34 which is adjustable.

As is shown in FIG. 1A there are three sets of the rollers 32. In order that the pipes P being cleaned may be rotated, at least one set of the rollers 32 and preferably all of the sets are driven by way of a simple motor.

Figure 2:
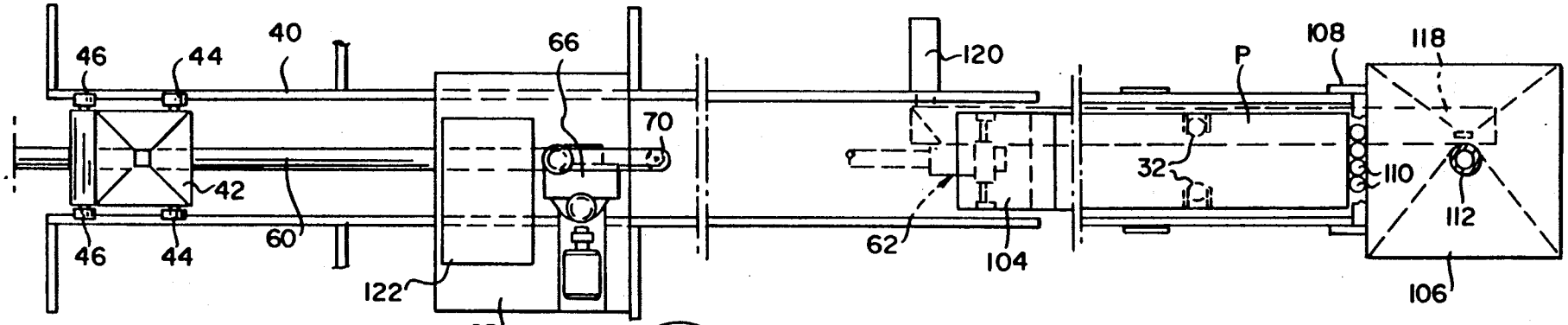
FIG. 2 is a top plan view of the pipe cleaner of FIGS. 1A, 1B with intermediate portions broken away.
Figure 1B:
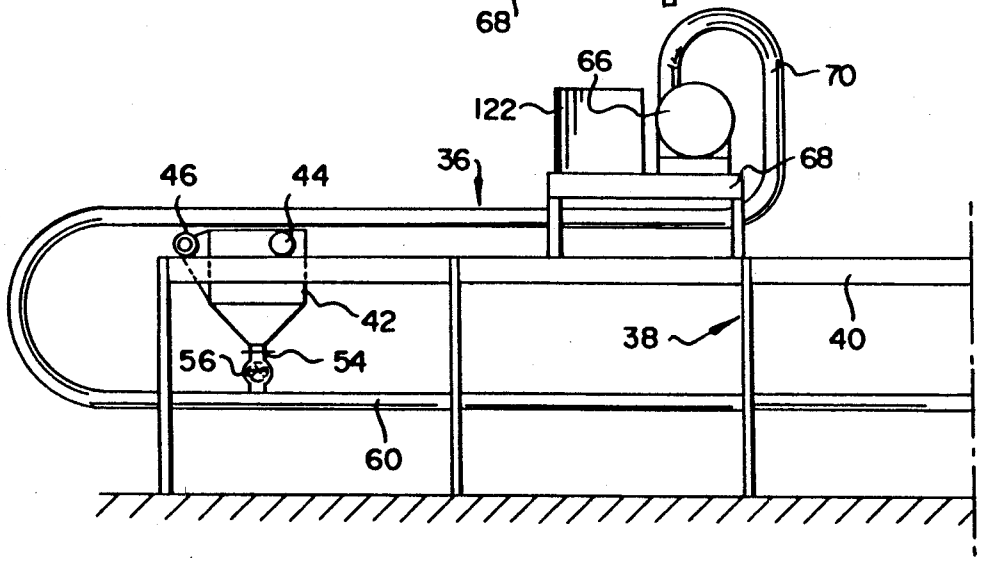

As is best shown in FIGS. 1A, 1B and 2 there is associated with the pipe support 12 a pipe cleaner generally identified by the numeral 36. The pipe cleaner 36 includes a supporting frame, generally identified by the numeral 38 which includes a pair of uppermost rails 40 which are transversely spaced as is clearly shown in FIGS. 2 and 4. A travelling hopper 42 for abrasive particles is provided with sets of wheels 44, 46 which ride on the rails 40.

Figure 4:
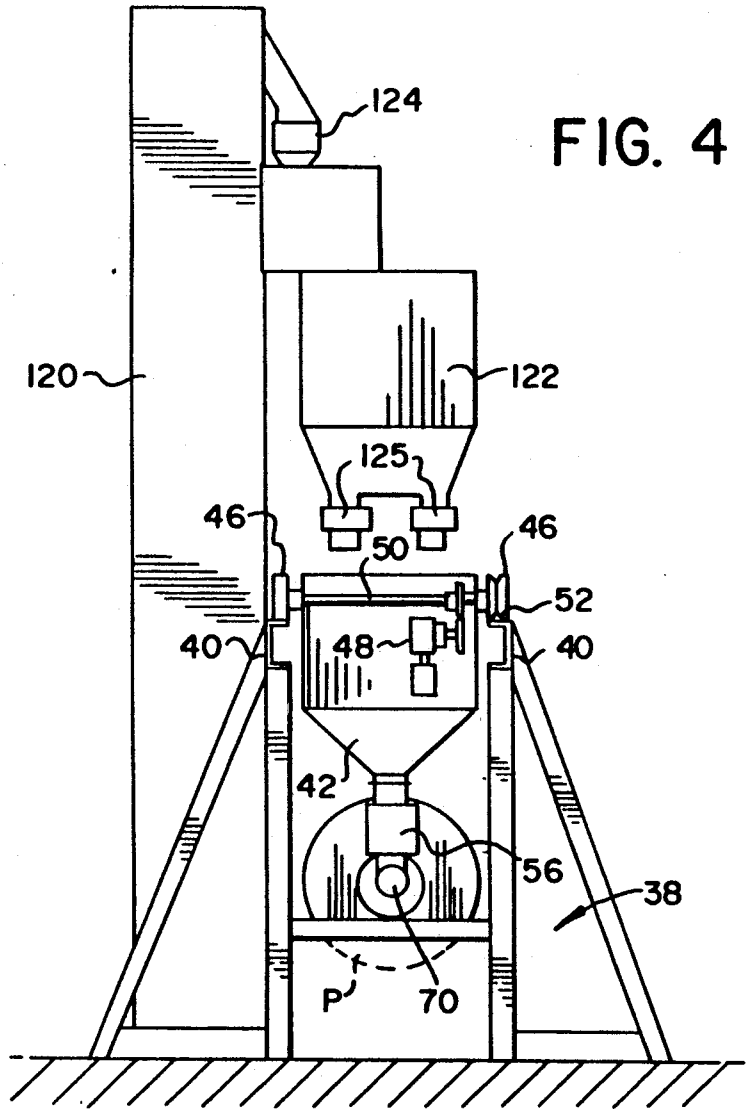
FIG. 4 is a transverse elevational view showing further the details of an abrasive particle supply and its association with an abrasive hopper and the cleaning mechanism associated therewith.

As is best shown in FIG. 4, there is a drive mechanism 48 carried by the hopper 42 which is coupled to a common axle 50 for the wheels 46. In this manner the hopper 42 is controllably driven back and forth along the rails 40.

Also, as is shown in FIG. 4, at least one of the rails 40 has mounted on the upper surface thereof a triangular cross sectional rail head 52. Those of the wheels 44, 46 which engage the rail head 52 have generally a V-shaped cross sectional surface matching that of the rail head 52 so as to maintain a hopper 42 on the rails 40.

The hopper 42 has a lower discharge pipe 54 which is provided with a rotary valve 56. The lower end of the discharge pipe 54 has rigidly secured thereto a boom 60 which is in sealed communication with the discharge pipe 54 lower end. The boom 60 extends to the right as is shown in FIGS. 1A, 1B and is provided at the right free end thereof with a cleaning head generally identified by the numeral 62. If desired, adjacent the pipe support 12 there may be a roller type support 64 for the boom 60.

At this time it is pointed out that the boom 60 has a longitudinal axis which is aligned with the longitudinal axis of a pipe P being cleaned as determined by the position of the rollers 32.

An air blower unit 66 is mounted on a suitable support 68 carried by the supporting frame 38 above the rails 40. A flexible hose 70 extends from the air blower unit 66 initially first to the left and then to the right and is suitably coupled to the boom 60 to the left of the connection between the discharge pipe 54 and the boom 60 as is clearly shown in FIG. 1B.

Figure 5:
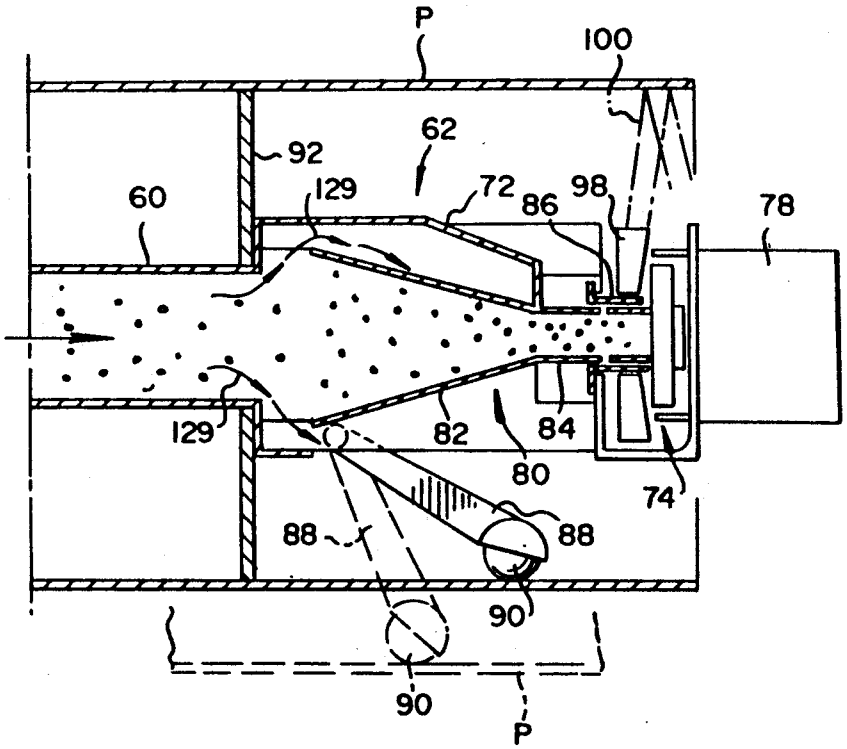
FIG. 5 is a fragmentary longitudinal vertical sectional view showing generally the details of the cleaning head and the manner in which it may be adjusted to support the cleaning head in two different diameter pipes.

Reference is now made to FIG. 5 wherein the cleaning head 62 is illustrated within a pipe P in a pipe cleaning position. It will be seen that the cleaning head 62 includes a suitable housing 72 which carries at its forward end a known type of blast wheel, generally identified by the numeral 74. The blast wheel 74 has a drive shaft 76 which is part of a hydraulic motor (not shown) mounted within a protective housing 78 at the front of the housing 72.

It will be seen that the housing 72 is mounted at the open forward end of the boom 60 for receiving through the boom 60 a mixture of compressed air and abrasive particles.

The cleaning head 62 also includes a center conduit, generally identified by the numeral 80 which is positioned between the free end of the boom 60 and the blast wheel 74. The conduit 80 includes a generally funnel shaped portion 82 which terminates in a discharge tube 84. The entrance end of the funnel shaped portion 82 is of a larger diameter than the exit of the boom 60 and is axially spaced a distance from the free end of the boom 60. On the other hand, the discharge tube 84 is of a diameter corresponding essentially to the diameter of the impeller 94 of the blast wheel.

At this time it is to be noted that the housing 72 is provided with three adjustable arms 88 which terminate in support balls 90 which are mounted for rotation. By adjusting the position of the arms 88, the cleaning head 62 may be supported in a centered position in pipe P of different diameters as is clearly shown in FIG. 5.

At this time it is also to be noted that as is clearly shown in FIG. 5, the cleaning head at its connection with the boom 60 is provided with a seal member 92. The seal member 92 is interchangeable and is of a diameter corresponding to the internal diameter of the pipe P being cleaned so as to seal the pipe against both the flow of compressed air to the left out of the pipe P and the loss of abrasive particles.

Figure 7:
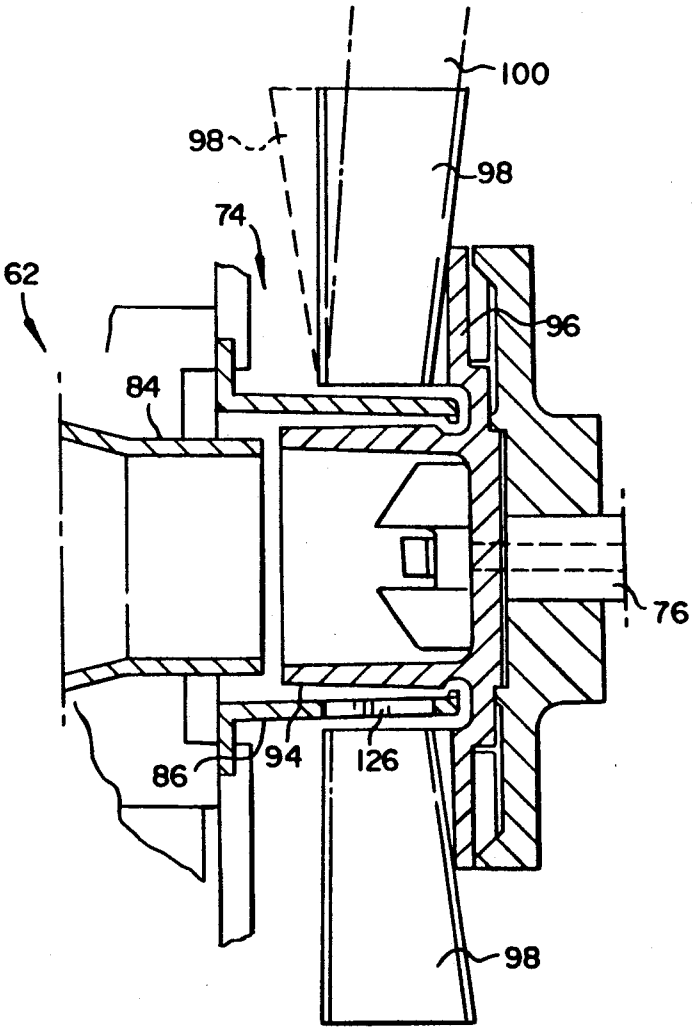
FIG. 7 is a fragmentary longitudinal sectional view taken through the blast wheel or head and shows the specific details thereof.

Referring now to FIG. 7, it will be seen that the blast wheel includes an impeller 94 which is rotatably mounted within the impeller case 86 and is coupled to a wheel 96 for rotation. The wheel 96, in turn, carries a plurality of circumferentially spaced, radially extending vanes 98. The vanes 98 are of a flared type as is disclosed in U.S. Pat. No. 3,348,339. The tilt and flare of the vanes 98 correspond generally to those of the canted vanes of that patent. However in accordance with this invention, all of the vanes are canted in the same direction. On the other hand, every other vane 98 is cantered at a different angle. For example, 4° and 6°. This provides for a wider blast pattern.

A 1½" wide pattern from each vane gives a resultant pattern of 2¼" wide on a 48"0 diameter pipe. The advantage of this is to prevent barber poling, the pipe must rotate at least one time in every blast width of boom travel. If the pattern is 1½" wide and the boom travel is 5 feet per minute, the minimum RPM of the pipe would be 40 RPM. If the blast width is increased to 2174 ", then the RPM could be reduced to 26.6 RPM. On the other hand, if the RPM is kept at 40, there would be a greater blast overlap with the 2¼" pattern and thus more uniform cleaning.

Referring once again to FIG. 5, it will be seen that the path of abrasive particles thrown by the vanes 98 is identified by the numeral 100 and is a spiral one generally directed towards the right end of the pipe P. Also, as is best shown in FIG. 6, due to the specific configuration relationship of the vanes 98, the pattern 100 of the abrasive particles is generally fan shaped. Finally, it will be seen that the flow of abrasive particles from the blast wheel 74 is such that an individual particle will strike the inside of the pipe P at high velocity on the order of 295 feet per second and ricochet velocity from a 36" diameter pipe in an effective velocity of 194 feet per second and impacts the pipe a second time at 60° as at 102 in FIG. 6. Further, it will be seen that the same abrasive particle will strike the interior of the pipe at several other points with less effectiveness.

Reference is now made to FIG. 1A where it will be seen that there is illustrated a pipe P in position to be cleaned. First of all, there is placed on the left end of the pipe P an adapter 104 which is of a length to receive the cleaning head 62 while the abrasive particle is cleaning the extreme left end of the interior of the pipe P.

Next, it will be seen that at the right end of the pipe support 12 there is a receptacle 106 for receiving spent air, abrasive particles and foreign matter moved from within the interior of the pipe P. The receptacle has an entrance sleeve 108 in which the right end of the pipe P is received. Further, within the bottom part of the sleeve 108 there is a suitable thrust bearing 110 against which the right end of the pipe P bears, particularly when the pipe P is tilted as is shown in FIG. 1A.

The receptacle 106 is provided at the top with an exhaust 112 which, if necessary, may be connected to a suitable filter. The bottom of the receptacle 106 is in the form of a hopper or chute 114 with an exit 116 that overlies the horizontal conveyor 118. The horizontal conveyor 118 runs under the pipe support 20 and is connected to a vertical conveyor 120. The vertical conveyor 120 is part of a support for a supply hopper 122 which receives abrasive particles from the vertical conveyor 120 by way of an upper horizontal conveyor 124. The hopper 122 has discharge valves 125.

OPERATION

In the operation of the pipe cleaner 10, the diameter of the pipe to be cleaned is first determined and the rollers 32 of the pipe support 20 are adjusted to accommodate that pipe. Also, the arms 88 and the ball rollers carried thereby are adjusted to fit the interior of that pipe. In addition, the cleaning head 62 is provided with the seal member 92 of the appropriate size.

The pipe is then seated on the rollers 32 in the position illustrated in FIG. 1A. Then the adapter ring 104 is applied if it has not already been applied. Now the pipe P is ready to receive the cleaning head 62.

As is best shown in FIG. 3, the boom 60 is advanced until the cleaning head 62 reaches the extreme right end of the pipe P at a position where abrasive particles thrown by the blast wheel 74 will clean the extreme right interior of the pipe P. At this time the hopper 42 underlies the supply hopper 122 at which time valves 125 open downwardly and the required abrasive particles are placed within the hopper 42 for cleaning the pipe P.

After the hopper 42 has been supplied with the abrasive particles, the supply valves 125 close.

The air blower 66 is now actuated to supply the boom 60 with compressed air at the desired pressure. Also, hydraulic fluid is directed to the motor from hydraulic power unit 127 for the blast wheel so that the blast wheel begins to rotate. At this time the valve 56 is rotated to direct abrasive particles into the boom 60 to be carried by the flowing compressed air.

Referring once again to FIG. 5, it will be seen that as the mixture of compressed air and abrasive particles exit the boom 60, the abrasive particles will all enter into the conduit 82 due to the inertia of the abrasive for delivery to the blast wheel 74 since all of the air cannot flow through the impeller case opening 126 there will be diverted an excess of air around the conduit 82 as shown by arrows 129 while there will be a suitable flow of compressed air around the conduit 82 and also from the area of the blast wheel 74 through opening 126 a continuous stream of compressed air flowing into the pipe P past the cleaning head 62. This will add to the spiral momentum of the abrasive particles to continue the flow of the abrasive particles and removed foreign matter towards the receptacle 106.

The boom 60 continues to withdraw until the blast abrasive particles reaches the interior of the left end of the pipe P to fully clean the pipe. At this time the cleaning operation is completed.

The supplying of abrasive particles and the compressed air is discontinued at this point and the cleaning head 62 is fully withdrawn from the adapter ring 104. At this time, as is shown in FIG. 1A, the pipe support frame 18 is tilted about the pivot 16 by the jack 24. At this time, the rollers 32 are still being driven so as to effect the flow of spent abrasive particles and foreign matter moved thereby down the sloping pipe into the receptacle 106. The foreign matter is generally removed through the pipe 112 while the spent abrasive particles pass down through the hopper portion 114 to the conveyor 118 for return to the supply hopper 122.

Although certain adjustments are required when the size of a pipe is changed, it is to be understood that normally a large number of pipes of the same diameter will be cleaned and the adjustment of the pipe cleaner 10 need be affected only occasionally.

Although only a preferred embodiment of the pipe cleaner has been specifically illustrated and described herein, it is to be understood that minor variations may be made therein without departing from the spirit and scope of the invention as defined by the appended claims.

I claim:

1. A method of internally cleaning pipe, said method comprising the steps of mounting a pipe in a generally horizontal position, placing an abrasive throwing wheel cleaning head in a forward end of such pipe through a rear end of such pipe, rotating said such pipe about its axis, supplying compressed air and abrasive particles to said cleaning head and throwing said abrasive particles radially outwardly against such pipe while gradually withdrawing said cleaning head through such pipe to progressively clean an interior of such pipe from its forward end to its rear end, and then replacing such pipe.

2. A method according to claim 1 wherein said abrasive particles are carried by said compressed air, and said abrasive particles are removed from said compressed air at said cleaning head and directed into said cleaning head while said compressed air passes around said cleaning head and moves spent abrasive particles to said pipe forward end.

3. A method according to claim 2 wherein abrasives are drained from such pipe by elevating said pipe rear end while maintaining said pipe forward end in its cleaning position to direct abrasive particles from such pipe through its forward end.

4. A method according to claim 3 wherein such pipe is rotated while said rear end is elevated.

5. A method according to claim 1 wherein such pipe rear end only during pipe cleaning is provided with an adapter for extending the length of such pipe at such pipe rear end to provide for complete length abrasive blasting of such pipe.

6. A method according to claim 1 wherein the cleaning head is carried by an elongated tubular boom with said boom having connected (thereto) to said boom a compressed air hose and an abrasive particle hopper, there is a fixed abrasive particle supply, and when the cleaning head is at such pipe forward end the abrasive particle hopper is positioned under the abrasive particle supply and refilled thereby.

7. A method according to claim 1 wherein abrasive particles are thrown only generally upward against such pipe for multiple ricocheting.

8. A cleaning device for internally cleaning pipe, said cleaning device comprising a travelling support, a boom carried by said travelling support, an abrasive cleaning head carried by a free end of said boom, means connected to said travelling support for moving said boom lontitudinally and axially of said boom, and said travelling support including a travelling abrasive hopper connected directly to said boom in boom supporting relation for movement in unison with said boom, for supplying abrasive particles to said cleaning head.

9. A cleaning device according to claim 8 wherein there is a compressed air supply, and a flexible hose connects said compressed air supply directly to an interior of said boom upstream of said abrasive hopper with compressed air forming a carrier for abrasive particles within said boom.

10. A cleaning device according to claim 9 wherein said cleaning head includes a blast wheel spaced from an adjacent end of said boom, a combined air diverter and abrasive particle separator axially aligned with and positioned between said boom and said blast wheel for collecting abrasive particles from said compressed air and directing said diverted compressed air around said blast wheel and aid in movement of abrasive particles and foreign particles towards said receptacle.

11. A cleaning device according to claim 8 together with a pipe support aligned with said boom, and an abrasive and removed foreign matter receptacle at an end of said pipe support remote from said travelling support.

12. A cleaning device according to claim 11 wherein said pipe support includes a support frame, pairs of transverse rollers carried by said support frame, each of said rollers being mounted on said support frame by a pivot arm swingable in a plane transversely of said boom, and means for adjusting the position of each pivot arm for raising and lowering diameters all on a center line aligned with said boom.

13. A cleaning device according to claim 12 wherein said support frame is mounted for pivotal movement about a transverse axis adjacent said receptacle for tilting a newly cleaned pipe only upwardly away from said receptacle to empty abrasive particles and foreign matter from a newly cleaned pipe into said receptacle.

14. A cleaning device according to claim 11 wherein said abrasive cleaning head is in the form of a blast wheel including a plurality of radiating vanes, said vanes being canted with abrasive particles from said blast wheel moving in a spiral pattern towards said receptacle.

15. A cleaning device according to claim 8 wherein said abrasive cleaning head is in the form of a blast wheel including a plurality of radiating vanes, and adjustable support arms carried by said cleaning head for engaging a pipe being cleaned to maintain said cleaning head centered within pipes of different diameters.

16. A cleaning device according to claim 1 wherein said abrasive cleaning head is in the form of a blast wheel including a plurality of radiating vanes, said blast wheel being oriented to throw abrasive particles generally vertically only to effect multiple abrasive particle ricochet with a minimum of interference.

17. A cleaning device according to claim 1 wherein said abrasive cleaning head is in the form of a blast wheel including a plurality of radiating vanes, said vanes being canted with every other vane being canted at different angles to provide for a wide blast pattern.

18. A cleaning head comprising a supporting framework, a blast wheel including a rotatable wheel having radially projecting and circumferentially spaced vanes, means for securing said supporting framework and an open free end of a boom with said boom directly supplying compressed air having abrasive particles entrained therein, a conduit having an entrance end at said boom free end for receiving compressed air and all abrasive particles, said boom having an air capacity in excess of said blast wheel whereby air is diverted around said blast wheel.

19. A cleaning head according to claim 18 wherein said vanes are all canted in one direction to direct abrasive particles out of a pipe being cleaned.

20. A cleaning head according to claim 19 wherein the canting of adjacent vanes is different to provide a wider blast pattern.

* * * * *